United States Patent [19]

Anderson

[11] Patent Number: 4,543,881

[45] Date of Patent: Oct. 1, 1985

[54] INTERNAL ROLL COMPRESSION SYSTEM

[76] Inventor: Graydon E. Anderson, 850 Latonka Dr., R.D. 4, Mercer, Pa. 16137

[21] Appl. No.: 577,981

[22] Filed: Feb. 8, 1984

[51] Int. Cl.[4] ..... B30B 9/20

[52] U.S. Cl. ..... 100/121; 100/157; 100/905

[58] Field of Search ..... 100/121, 157, 905

[56] References Cited

U.S. PATENT DOCUMENTS 2,682,832 7/1954 Lohre et al. ..... 100/121

4,355,573 10/1982 Berry ..... 100/121

FOREIGN PATENT DOCUMENTS 822601 9/1937 France ..... 100/157

*Primary Examiner*—Peter Feldman

[57] ABSTRACT

This invention is a machine for squeezing water out of peat or other material of low tensile strength; the machine including an inner roll eccentrically positioned inside a tubular outer roll, so as to form a gradually increasing pinch area at one point therebetween, so that, as the rolls rotate, the material is placed between the rolls, and gets wrung out when passing through the pinch area.

1 Claim, 5 Drawing Figures

INTERNAL ROLL COMPRESSION SYSTEM

This invention relates to machines used for dewatering peat.

The United States has a significant peat resource. The energy content in this resource is estimated to be equivalent to about 240 billion barrels of oil. Peat is low in sulfur, and can be low in ash, too. In addition, on the basis of its chemistry and kinetics, peat is a better feedstock than coal for synthetic fuels production.

It is well known to those persons acquainted with the particular field, that peat, as found in nature, often contains as much as nine pounds of water per pound of dry peat. To be seriously considered as a feedstock for conversion to synthetic fuels, or for direct combustion, this pound of dry peat should contain less than 1 pound of water. In other words, more than 85 percent of the water originally present must be removed. Finding a more effective and efficient method of dewatering peat has been the most significant obstacle to peat utilization. Dry harvesting methods (sod and milled peats), employed extensively in Europe, are capable of producing peat with moisture contents below fifty weight-percentage. But, these procedures rely on solar energy and convective forces for drying. They are not economically feasible in the north and northeastern states, where most of the U.S. peat deposits are found. In these regions, use of wet harvesting methods, followed by conventional dewatering devices can achieve, at best, a peat moisture content of sixty-five weight-percentage. Evaporation (or thermal drying) is quite effective, but its enormous energy requirements with their related costs limit its use. Thermal pretreatment, to improve the mechanical dewaterability of peat (such as wet carbonization followed by mechanical dewatering), can achieve a peat moisture content of less than fifty weight-percentage.

At its current stage of development, however, this pretreatment is not economically competitive in many U.S. peat-rich regions.

Accordingly, it is a principal object of the present invention to provide a machine employing an internal rotary compression system for the purpose of reducing moisture content of peat, or any other squeezable material, to fifty weight-percentage; and which utilizes a principle whereby severe mechanical compression and a shear action on peat is generated, so as to remove moisture better than by conventional mechanical devices.

More specifically, an object of the present invention is to provide an internal rotary compression system, having the following advantages over the systems of current mechanical dewatering devices:

(1) Improved peat dewatering potential, due to its ability to apply, simultaneously, severe compression and shear forces to peat, by means of using non-porous roll surfaces;

(2) Reduced unit cost due to smaller size, because rolling surfaces are internal;

(3) Field-portability permitted by its compact size, which reduces operating costs, and (4) A favorable no-slip entry of peat to the pinch area, which permits gradual compression, and maintains its unit compactness.

Another object is to provide an internal rotary compression machine, that produces a continuous compression action, and maximizes the squeeze by using a slow rolling wedge-shaped entrance into a rolling pinch area, thus forming a slow rolling wedge lock, that is unique in this art.

Other objects are to provide an internal roll compression system, which is simple in design, inexpensive to manufacture, rugged in construction, easy to use, and efficient in operation.

These, and other objects, will be readily evident, upon a study of the following specification, and the accompanying drawings, wherein.

Figure 4:
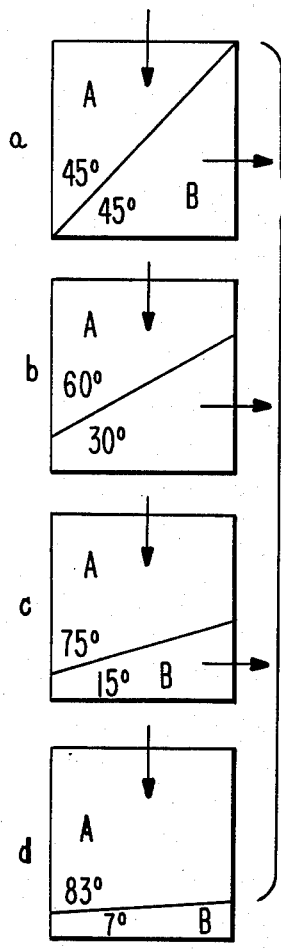
Figure 5:
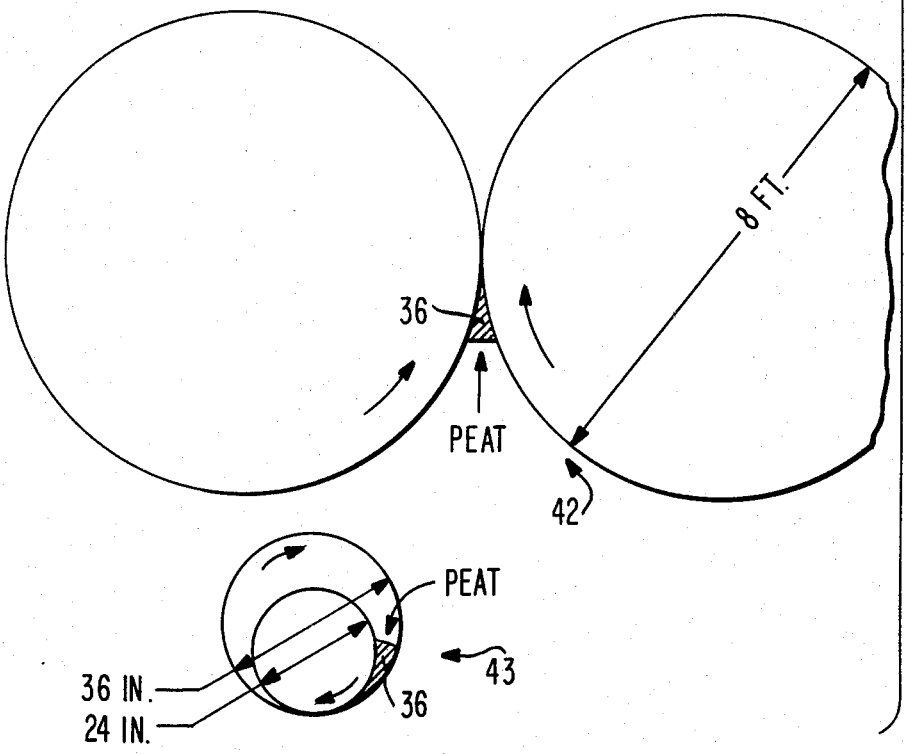

FIG. 4 is a set of diagrams illustrating different examples of the theory of a "no slip entry/exit" or "rolling wedge lock" approach, and FIG. 5 illustrates, diagrammatically, a compression of equivalently sized press areas of an external roll compression system, requiring large rollers or rolls, and the internal roll compression system of the present invention, requiring much smaller rollers or rolls.

Referring now to the drawings in greater detail, the reference numeral 10 represents an internal roll compression machine, according to the present invention, wherein there is a framework 11, on which there are supported a tubular outer roll 12, having an internal compressing surface 12*a*, and an internal roll 13, having an external compressing surface 13*a*. The outer roll is supported rotatably free on bearing rollers 14, turning on pins 15 mounted on the framework. The internal roll is received inside the outer roll, and hubs 16 on its outer ends turn in bearings of arms 17 supported freely rotatable on a drive shaft 18 supported on the framework.

The external roll is rotated by a variable speed drive mechanism 19, that includes a ring gear 20 affixed to roller 12; the gear being engaged by a gear 21 affixed on a drive shaft 22, journalled in bearings on the framework, and the drive shaft having a hub 23, for being engaged by an endless belt of a motor or engine (not shown).

The internal roll is rotated by a variable speed drive mechanism 24, that includes a sprocket 25 affixed on one of the hubs 16, and which is engaged by endless chain 26 engaging sprocket 27 affixed on the drive shaft 18 journalled in bearings on the framework, and the drive shaft having a hub 28, for being engaged by an endless belt of a motor or engine (also not shown).

An hydraulic cylinder 29, also mounted on the framework, includes a piston rod arm 30 mounted rotatably free on the hubs 16, and serves to shift the inner roll eccentrically inside the outer roll, in order to bring surfaces 12*a* and 13*a* closer together at one point, in order to squeeze peat therebetween, and squeeze out the water therefrom.

Figure 1:
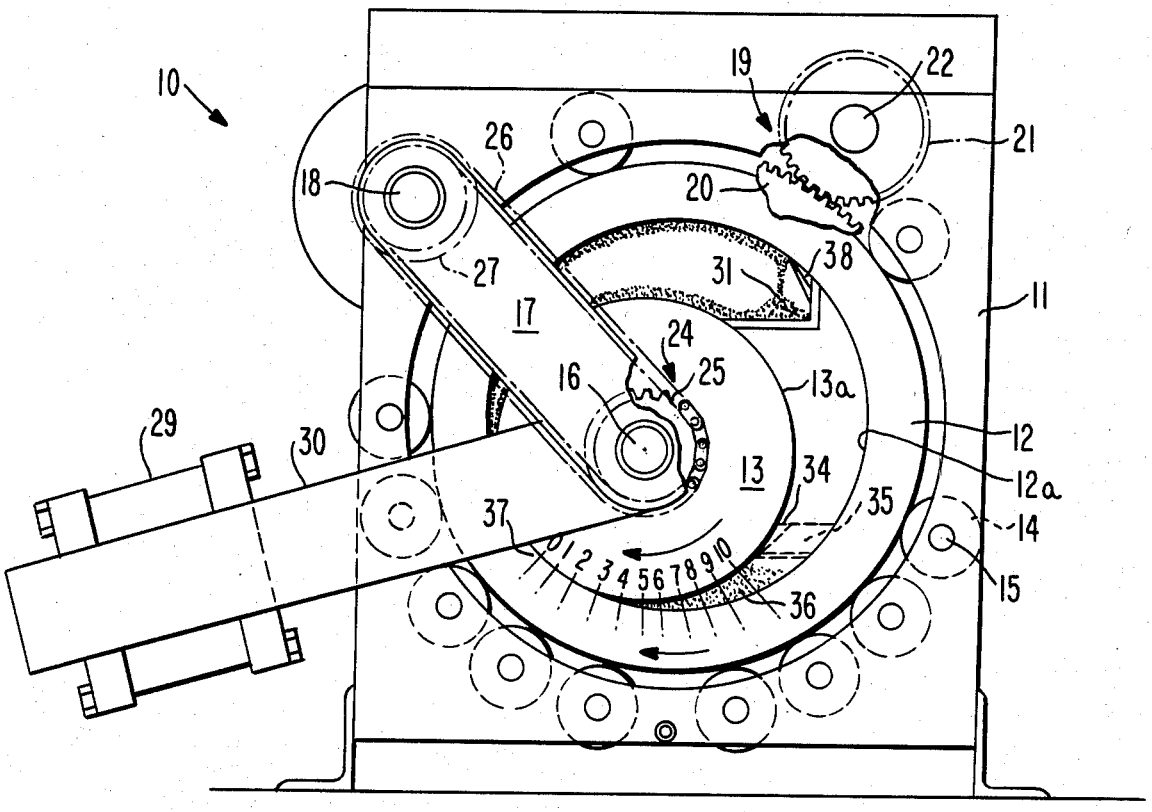
FIG. 1 is an end elevational view of the compression mechanism of the invention.
Figure 2:
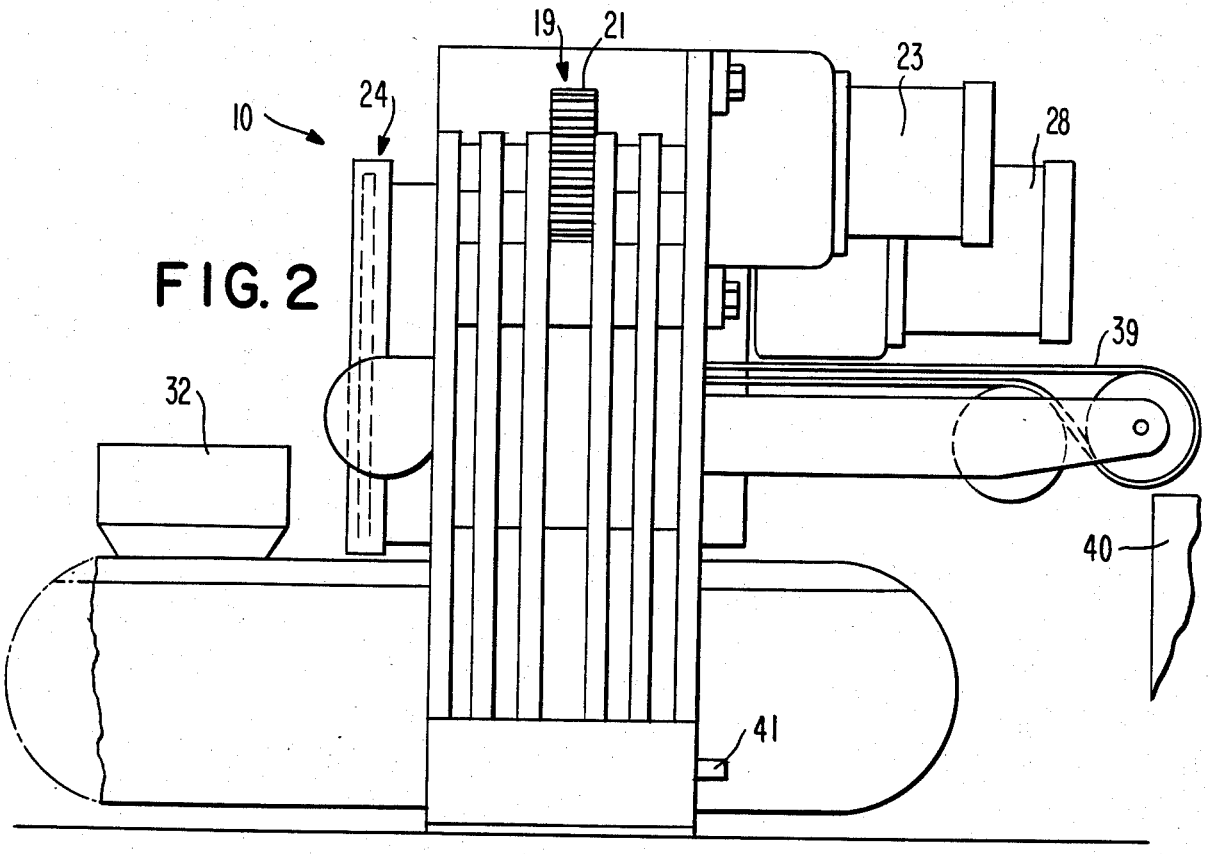
FIG. 2 is a side elevational view thereof.
Figure 3:
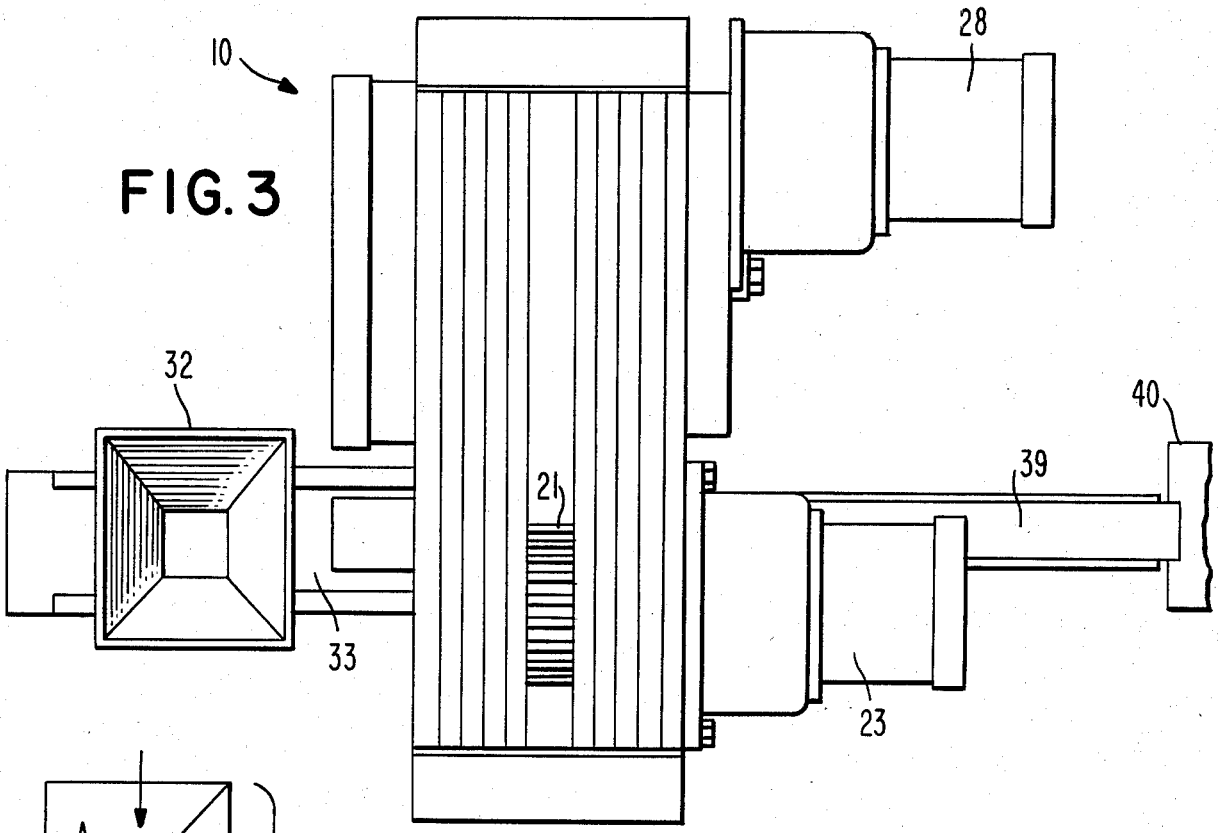
FIG. 3 is a top plan view thereof.

In operation, both rolls rotate in the same direction, as indicated by the arrows in FIG. 1.

In operative use, peat slurry 31, or other shredded substances, is loaded into a raw material hopper 32, from where it feeds out upon a conveyor belt 33, carrying it to a wide entry 34 of a space formed between surfaces 12*a* and 13*a*, where a wiper 35 wipes the material off the belt, so as to drop down into a pinch area 36, which gradually narrows to a final pinch joint 37, where compression on the material is at a maximum. The slow rolling wedge-shaped entrance into the rolling pinch is at an angle of less than seven degrees between the squeeze point where the surface 13*a* starts the pinch point with the surface 12*a*. After passing through the final pinch point, some of the compressed peat may possible adhere to the surfaces 12*a* and 13*a*, and which is then scraped off by means of wiper blades 38, so that all the squeezed peat is thus dropped upon a discharge conveyor 39, which transports it outside of the machine, and drops it into a finished material hopper 40, from where it is taken for possible further processing, such as into pellets, or is directly packaged. The water squeezed out from the peat is discharged from an outlet pipe 41; it being noted that the amount of water squeezed from the peat is controlled selectively from the hydraulic cylinder pressure and the adjusted rotational speed of the rolls. By operating the rolls at different speeds at their surfaces 12*a* and 13*a*, shear forces, in addition to a compression force, act on the peat for dewatering purposes.

Reference is now made to FIG. 4, wherein the present machine and its process is indicated having been evolved from, and developed around, the theory of a "no slip entry/exit" or "rolling wedge lock" approach. In the example illustrated at a, the mechanical downward movement of member A equals the sidewardly outward movement of member B. In the example illustrated at b, the mechanical downward movement of member A produces a lesser sidewardly outward movement of member B. In the example illustrated at c, a still further lesser movement of member B is attained. While a similarly additionally lesser movement should be expected in the example at d, the facts are that, instead of this, it will lock up, and this angle becomes the area of "no slip entry/exit"; sideway (or exit) resistance being greater than downward pressure.

Referring now to FIG. 5, an equivalent same size of pinch area 36 is shown, for a conventional external roll system 42, and also for an internal roll compression system 43 of the present invention; it being evident that, for the former, the rolls must be of enormous size, while, for the latter, the rolls are greatly reduced in size for accomplishing the same work volume.

While various changes may be made in the detail construction, it is understood that such changes will be within the spirit and scope of the present invention, as is defined by the appended claims.

What I now claim is:

1. An internal roll compression system, comprising, in combination, a framework, a tubular outer roll carried rotatably free upon a plurality of bearing rollers supported on said framework, an inner roll rotatable within said outer roll and being eccentrically positioned respective thereto so as to form a pinch area therebetween leading to a final pinch point, a hub on opposite ends of said inner roll being supported rotatably free in bearings at one end of arms supported pivotally free at their other ends on a drive shaft of a first motor mounted stationarily on said framework; a first sprocket affixed on one of said hubs, a second sprocket affixed on said drive shaft, an endless chain around both said sprockets; a ring gear affixed to said outer roll being engaged by a gear affixed on a drive shaft of a second motor affixed on said framework; a hydraulic cylinder supported on said frame having a piston rod mounted rotatably free at its outer end on one of said hubs; and a conveyor belt under a hopper for shredded substances communicating with a wide entry space of said pinch area.

* * * * *